US006068255A

United States Patent [19]

Nicoll

[11] Patent Number: 6,068,255

[45] Date of Patent: May 30, 2000

[54] DOCUMENT TRANSPORT APPARATUS

[75] Inventor: Kenneth A. Nicoll, Dundee, United Kingdom

[73] Assignee: NCR Corporation, Dayton, Ohio

[21] Appl. No.: 09/079,492

[22] Filed: May 15, 1998

[30] Foreign Application Priority Data

Sep. 5, 1997 [GB] United Kingdom ..... 9718799

[51] Int. Cl.[7] ..... B65H 29/68; B65G 1/00

[52] U.S. Cl. ..... 271/203; 271/216; 198/347.3

[58] Field of Search ..... 271/202, 203, 271/207, 212, 216; 270/52.07, 52.1; 198/347.3, 778; 156/269

[56] References Cited

U.S. PATENT DOCUMENTS

| | | | |
|---|---|---|---|
| 2,274,075 | 2/1942 | Bombard | 198/35 |
| 4,871,125 | 10/1989 | Haueter . | |
| 5,116,043 | 5/1992 | Jermann et al. | 271/216 X |
| 5,690,774 | 11/1997 | Greene | 156/269 |

FOREIGN PATENT DOCUMENTS

| | | |
|---|---|---|
| 0315932 | 5/1989 | European Pat. Off. . |
| 4441453 | 10/1989 | Germany . |
| 2097767 | 11/1982 | United Kingdom . |

*Primary Examiner*—Christopher P. Ellis
*Assistant Examiner*—Kenneth W. Bower
*Attorney, Agent, or Firm*—Gregory A. Welte

[57] ABSTRACT

Document transport apparatus (10) includes at least one pair of cooperating rollers (20A, 20B) for engaging documents therebetween and for defining a first stage (18) of a document transport path (16) for movement of documents therealong, the first stage (18) also being defined by at least one pair of tapes (28A, 28B) arranged such that one tape (28A) at least overlaps the other tape (28B) and such that documents are moved therebetween and relative thereto by the cooperating rollers (20A, 20B). Pinching means (26A, 26B) are further provided for pinching the tapes (28A, 28B) together so as to define another stage (22) in the transport path (16) in which the documents are sandwiched between the pinched tapes (24), and sensing means (40) can be located between the said one (18) and another (22) stages of the transport path (16) for detecting the presence of a document wherein a drive means for the forthcoming stage (18, 22) in the transport of a document is altered in response to an output from the sensing means (40) for the further transport of the document wherein the speed of travel of a document in one stage (18, 22) of the transport path is independent of the drive provided for the other stage.

22 Claims, 2 Drawing Sheets

DOCUMENT TRANSPORT APPARATUS

BACKGROUND OF THE INVENTION

The present invention relates to document transport apparatus and in particular, but not exclusively, to document storage and retrieval apparatus employing a document storage drum.

Disadvantages can arise with such apparatus in that the speed of delivery of documents cannot be readily controlled. Commonly an undesired increase, or decrease, in the speed at which the documents are delivered by means of the transport apparatus cannot be readily prevented.

Such disadvantages arise particularly with document storage and retrieval devices employing a document storage drum in which at least one pair of belts are pinched together so as to hold a document therebetween and the pinched belts then wound upon the drum with the documents retained between the belts. The drum can be driven in either a clockwise or an anticlockwise direction so as to effect storage or delivery of the documents. The drum is driven at a constant speed and as the number of documents stored on the drum increases so does the diameter of the drum/belt arrangement. As the belts are unwound from the drum, the speed at which documents are retrieved from the drum decreases as the diameter of the drum/belt arrangement decreases. Such a variation in the speed of document delivery can prove problematic and limits the manner in which the document storage and retrieval device can offer a reliable, simple and user-friendly apparatus for the steady and controlled delivery of documents. Also, the manner in which such apparatus is currently operated requires that an appropriate tension is maintained in the belts and this places a further demand on the complexity of such apparatus which can lead to further problems arising in relation to the useful operation and maintenance of the apparatus.

SUMMARY OF THE INVENTION

The object of the invention is to provide document transport apparatus having advantages over known transport apparatus.

Document transport apparatus characterized by one stage of a document transport path comprising at least one pair of cooperating rollers for engaging documents therebetween and at last one pair of belt means arranged such that documents can be moved between and relative thereto by the cooperating rollers; and another stage of the document transport path comprising pinching means for pinching the belt means together so that documents are sandwiched for retention between the pinched belt means, wherein the speed of travel of the documents in said one stage is determined by the speed of the cooperating rollers and in said another stage by the speed of the pinched belt means.

Advantageously, the determination of the speed of delivery of documents to said one stage, or of the speed of retrieval therefrom, is isolated from the speed of the belt means. Preferably, the apparatus includes sensing means located between said one and said another stages of the transport path for detecting the presence of a document wherein a drive means for the forthcoming stage in the transport of a document is altered in response to an output from the sensing means for the further transport of the document.

Preferably, the apparatus includes a plurality of pairs of belt means. Further, the at least one pair of rollers of the one stage of the document transport path may be located between adjacent pairs of belt means.

Advantageously, drive means for the forthcoming stage in the transport of the document can be altered so as to achieve two different speeds of movement.

The apparatus may also include a document presentation station wherein the pair of belt means extend from the document presentation station to the document storage drum.

Further, said one stage of the document transport path can extend between the document presentation station, and the pinching means and the second stage of the document transport path can extend between the pinching means and the storage drum.

In particular, the drive means can be provided to selectively drive the at least one pair of rollers within said one stage of the document transport path so as to correct any non-alignment detected with regard to the position of the document within the document transport path of the apparatus.

BRIEF DESCRIPTION OF THE DRAWINGS

The invention is described further hereinafter, by way of example only, with reference to the accompanying drawings in which.

DETAILED DESCRIPTION

Figure 1:
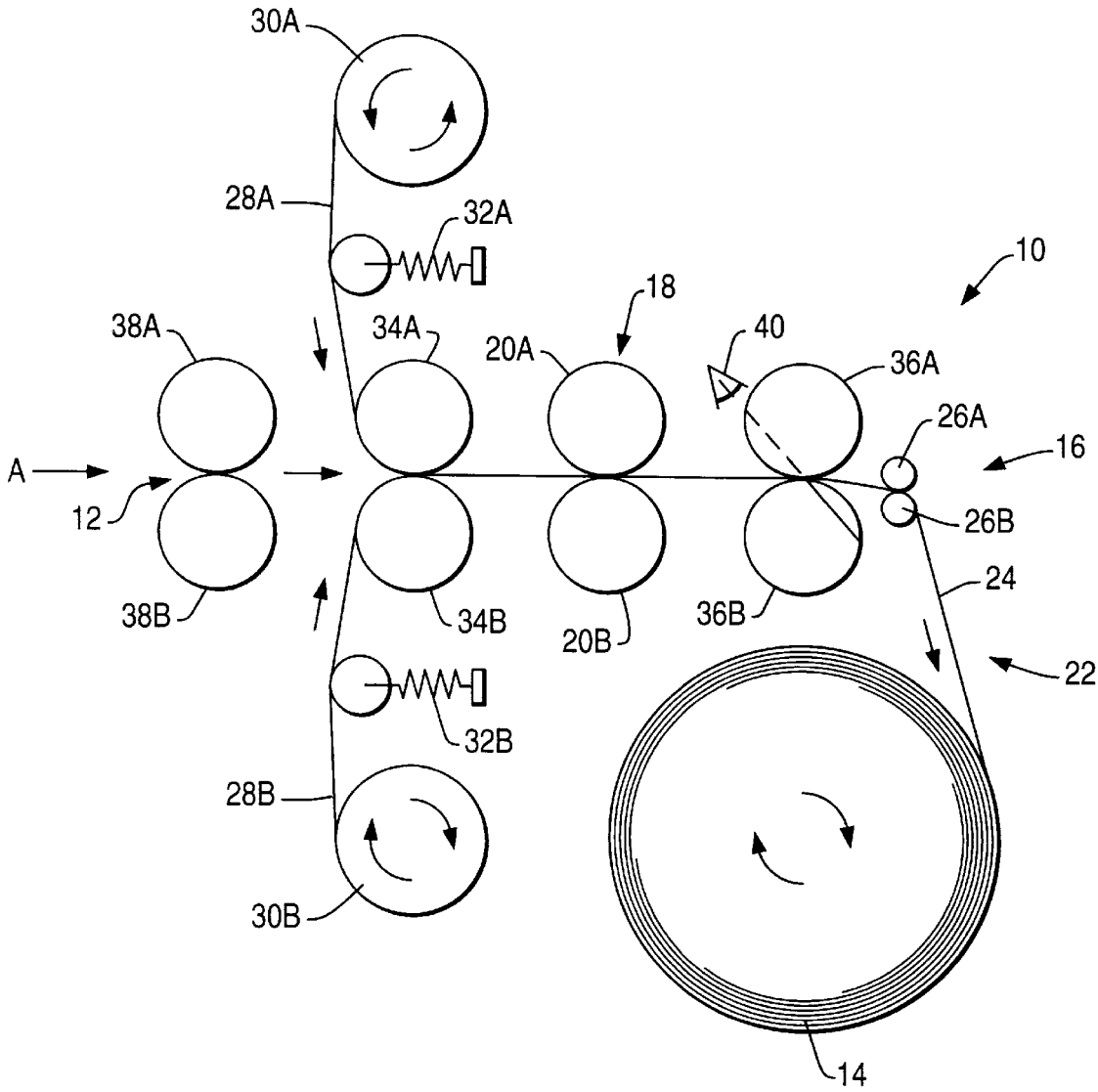
FIG. 1 is a schematic side view of a document storage and retrieval apparatus embodying the present invention.

FIG. 1 is a schematic side view of a document storage and retrieval apparatus 10 embodying the present invention in which documents can be delivered to, and retrieved from, the apparatus 10 via a document presentation station 12. Documents delivered to the apparatus 10 from the presentation station 12 are transported for storage around a document storage drum 14. Likewise, when documents are to be retrieved from the apparatus 10, they are retrieved from their storage location about the storage drum 14 and delivered to the document presentation station 12.

The transport of documents between the presentation station 12 and the storage drum 14 is conducted by way of a document transport path 16 which comprises a first stage 18 defined by a pair of cooperating rollers 20A, 20B, and a second stage 22 defined by overlapping, and generally overlaying, pinched belts in the form of tapes 24. As will be appreciated from FIG. 1, the aforementioned tapes also travel along the first stage 18 of the document transport path 16. However, prior to forming the second stage 22 of the document transport path 16 the tapes are pinched together by means of pinch rollers 26A, 26B so as to form the pinched tape 24 defining the second stage 22 of the document transport path 16.

The pinched tape 24 is derived from two separate tapes 28A, 28B which are stored on respective reels 30A, 30B. It will be appreciated that during storage of documents on the drum 14 the separate tapes 28A, 28B, are unwound from their respective reels 30A, 30B, travel through the first stage 18 of the document transport path 16, are pinched together by means of the pinch rollers 26A, 26B and are then retained in the pinched state 24 as they travel through the second stage 22 of the document transport path 16 so as to be wound around the drum 14.

During their passage from the respective reels 30A, 30B, the tapes 28A, 28B are maintained in tension by means of respective spring-loaded tensions 32A, 32B. Also, as illustrated within the drawing, further rollers 34A, 34B; 36A, 36B are provided at the first stage 18 of the document transport path 16 and a separate pair of rollers 38A, 38B is provided at the document presentation station 12. Finally, a sensor 40 is provided proximate to the transition between the first 18 and second 22 stages of the document transport path 16 and serves to detect the appearance of a document at such a position within the apparatus.

Figure 2:
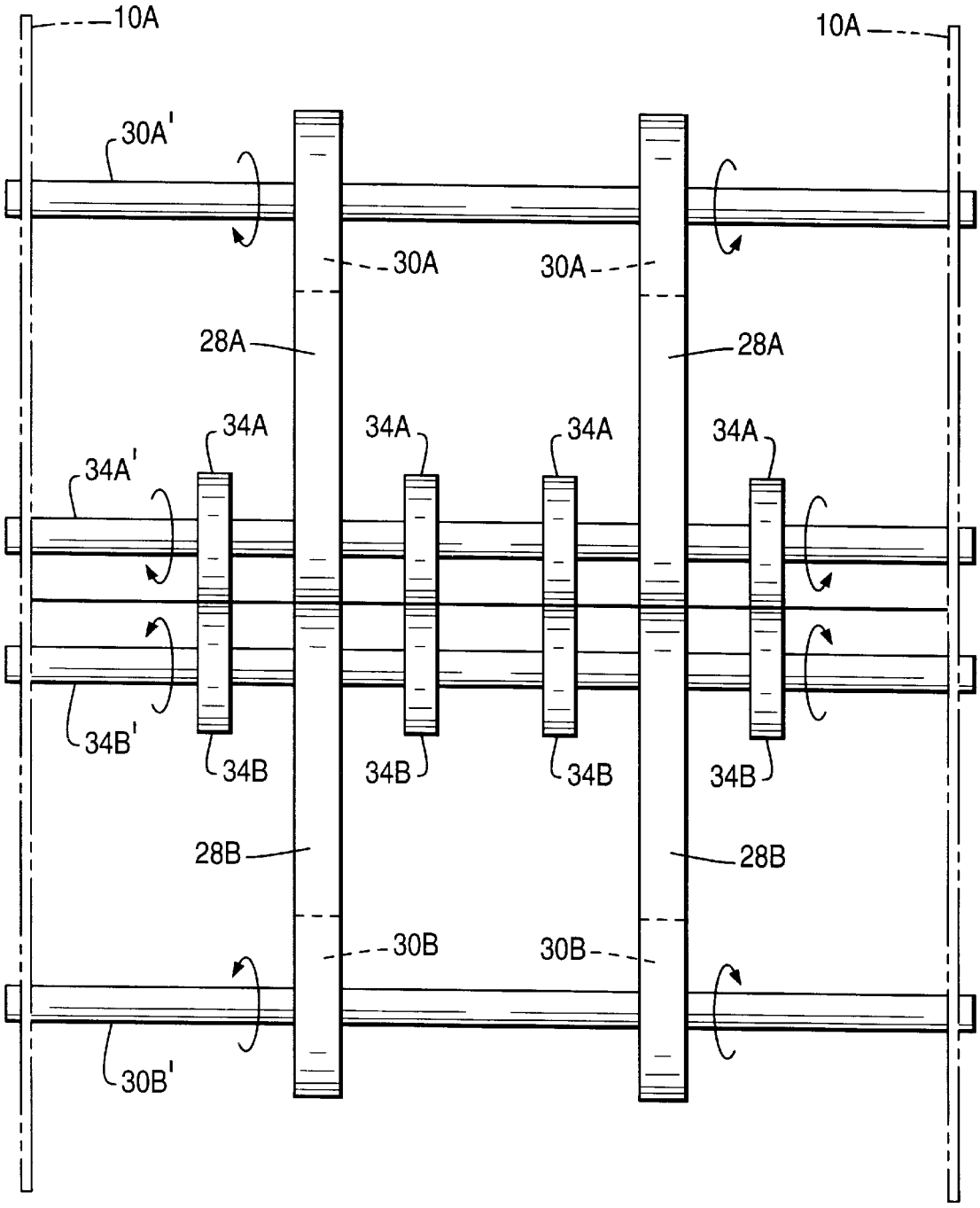
FIG. 2 is a schematic end view of the apparatus of FIG. 1 shown in the direction of arrow A.

The operation of the document storage and retrieval apparatus as illustrated in FIG. 1 can be appreciated further by reference to FIG. 2 in which common components are identified by the same reference numerals.

Operation of the apparatus during document storage is first considered.

If it is required to store a document on the document storage drum 14, the document is first presented to the apparatus 10 in the direction of arrow A at the document presentation station 12. The rollers 38A, 38B are driven so as to accept the document and deliver it towards the first stage 18 in the document transport path 16. As the document is delivered into the first stage 18 of the document transport path 16 it is taken up by the cooperating pairs of rollers 34A, 34B; 20A, 20B; 36A, 36B and transported along the first stage 18 in the document transport path. It should be appreciated that the transport of the document through the first stage 18 is conducted solely by means of the cooperating rollers 34A, 34B; 20A, 20B; 36A, 36B which engage the document so as to achieve such transport. However, the tapes 28A, 28B also extend through the first stage 18 of the document transport path 16 and a generally peripheral region of the document is located between the overlapping portions of the tapes 28A, 28B. However, the frictional relationship between the surfaces of the tapes 28A, 28B contacting the document, and the document itself, is such that the document can, when driven by the roller pairs 34A, 34B; 20A, 20B; 36A, 36B readily slide relative to the tapes 28A, 28B such that transport through the first stage 18 of the document transport path 16 is achieved irrespective of whether the tapes 28A, 28B are in motion.

The relative movement between the documents and the tapes is particularly advantageous in that it allows the tapes 28A, 28B to act as guides for the documents through the first stage 18 of the document transport path 16. Additional guide means can then be omitted from the apparatus 10.

The transport of the document through the first stage 18 of the document transport path 16 continues in this manner until such time as the sensor 40 senses the presence of the document. At this point in its transport, the document is nearing the pinch rollers 26A, 26B which serve to pinch together the tapes 28A, 28B and thus also tend to sandwich the document between the tapes 28A, 28B.

An output from the sensor 40 is provided as the document nears, or enters, the pinch rollers 26A, 26B and indicates the presence of a document at that location. This output serves as a control signal for altering the drive of the drum 14 so as to draw the tapes 28A, 28B through the pinch rollers 26A, 26B such that a pinched tape 24 is wound around the drum 14. The drawing of the tapes 28A, 28B through the pinch rollers 26A, 26B in this manner serves to draw the document towards the storage drum 14 and, in view of the pinched arrangement of the tapes 28A, 28B, the document is held securely therebetween in a sandwiched manner and can be readily stored around the storage drum 14. The low friction tapes employed as document guides through the first stage 18 of the document transport path 16 can then advantageously be employed as suitable storage means for the documents when wound around the drum 14. This has the further advantage that twin drive motors and gearing arrangements that might otherwise be needed are not required.

It will be appreciated that the above mode of operation can be repeated as required as further documents are presented at the document presentation station 12 for subsequent storage on the storage drum 14. However, as will be appreciated, although the diameter of the storage drum 14 increases as the documents are stored, the periodic operation of the drum 14 solely to transport documents identified at the end of the first stage 18 of the document transport path 16 by the sensor 40, and the fact that the delivery of the documents along the first stage 18 of the document transport path 16 is controlled solely by the speed of the roller pairs 34A, 34B; 20A, 20B; 36A, 36B, serves to maintain a constant speed at which documents can be received from the document presentation station.

In reverse, that is during document retrieval, the operation of the apparatus 10 is as follows.

Once it is identified that a document is to be retrieved from the drum 14, the drum is driven so as to unwind the pinched tape 24 so that the document secured between a portion of the pinched tapes 24 travels from the drum 14 along the second stage 22 of the document transport path 16 until it is sensed by the sensor 40 at the inner end of the first stage 18 of the document transport path 16. At this position the document can be engaged by the cooperating rollers of the first stage 18 of the transport path 16. Upon such detection, the sensor 40 provides an output which serves to alter the drive to the roller pairs 34A, 34B; 20A, 20B; 36A, 36B so that the document presented at the sensor 40 is driven away along the first stage 18 of the document transfer path 16 under the sole control of the roller pairs 34A, 34B; 20A, 20B; 36A, 36B. During such delivery by means of the roller pairs 34A, 34B; 20A, 20B; 36A, 36B, the tapes 28A, 28B can be arranged to remain stationary, or to move at a relatively slow speed, and the aforementioned frictional relationship between the document and the cooperating services of the tapes 28A, 28B, allows for the ready relative movement therebetween so that the roller pairs 34A, 34B; 20A, 20B; 36A, 36B can drive the document along the first stage 18 of the document transport path 16 irrespective of the movement, or non-movement, of the tapes 28A, 28B.

FIG. 2 illustrates further detail of the apparatus shown in FIG. 1 and represents a view from the front of the apparatus taken in the direction of arrow A of FIG. 1 but without the pinch rollers 38A, 38B of the document presentation station 12 in place. As will be appreciated, an upper region of the apparatus 10 comprises two adjacent tapes 28A and the lower region comprises two adjacent tapes 28B. Each of the tapes 28A in the upper region of the apparatus 10 is paired with a corresponding tape 28B of the lower region so as to be drawn together in the manner illustrated in FIG. 1. In the illustrated embodiment, the front region of the first portion 18 of the document transport path 16 is defined by four pinch rollers 34A, two of which are located between the upper tapes 38A and two of which are located on the other side of the upper tapes 28A. Rollers (not shown) are also provided coaxial with the upper pinch rollers 34A and which serve to draw the upper tapes 28A in the direction shown in FIG. 1.

The lower region of the apparatus 10 as illustrated in FIG. 2 represents a mirror image of the other portion and again comprises four pinch rollers 34B and further additional rollers for drawing the lower tape 28B in the direction shown in FIG. 1.

As will also be appreciated, the upper rollers 30A about which the end of upper tape 28A is wound are mounted about a common shaft 30A' and the rollers 30B about which the lower tape 28B is wound are mounted about a common shaft 30B'. The upper pinch rollers 34A defining a first region of the first portion 18 of the document transport path 16 are likewise mounted about a common shaft 34A' and again, as a mirror image, the lower pinch rollers 34B are mounted about a common shaft 34B' and the shafts 30A', 30B', 34A' and 34B' are mounted at each end in a side frame 10A of the apparatus.

FIG. 2 clearly illustrates how the pinch rollers of the document transport path and the tapes 28A and 28B are mounted in an adjacent manner so that a document fed in the direction of arrow A in FIG. 1 can be gripped by the cooperating pairs of pinch rollers 34A, 34B whilst being allowed to slide relative to the tapes 28A, 28B. The relative position of the pinch rollers 34A, 34B and the tapes 28A, 28B within FIG. 2 further illustrate the manner in which documents can be reorientated within the drive path 16 so that any documents having a proper orientation within the apparatus are delivered to the document presentation station 12 or collected by the pinched tape portion 24 (see FIG. 1) and wound around the drum 14. Advantageously, two or more sensors 40 such as that illustrated in FIG. 1 could be employed within the apparatus 10 as described later so as to detect for proper alignment of a document within the apparatus 10.

It will be appreciated therefore that the speed of delivery of documents from the first stage 18 of the document transport path 16 to the document presentation station 12 is determined solely by the speed of rotation of the roller pairs 34A, 34B; 20A, 20B; 36A, 36B which can be readily controlled to remain constant. Thus, the varying diameter of the drum/tape arrangement has no disadvantageous effect on the final retrieval of the documents from the apparatus since, during document retrieval, the drum and pinched tapes 24 merely serve to provide a first step in the retrieval of a document; which first step is effectively isolated from the final document delivery step of the apparatus 10.

The present invention therefore advantageously employs the differential frictional properties in the tapes relative to the documents so as to provide means by which the tension in the tapes has a reduced effect on the overall operation of the apparatus and in which documents can be delivered to, or retrieved from, the apparatus at a readily controllable and constant speed.

The actual mode of operation of the apparatus can of course be varied to suit particular requirements for example it is not necessary that tapes 28A, 28B remain stationery while the documents are driven along the first stage 18 of the document transport path 16.

Further, two or more sensors can advantageously be employed in place of a single sensor and which serve to provide confirmation that the document is appropriately aligned for transport through the apparatus. If such alignment is not detected, the apparatus can advantageously de-skew the documents. Appropriate alignment can then be achieved by means of appropriate control of the rollers which serve high friction devices and whereby the selective operation of which can serve as a brake and squaring device so as to reorientate the document within the transport path 16 prior to further transport therealong.

It should of course be appreciated that the present invention is not restricted to the details of the foregoing embodiments. For example, the apparatus may not be embodied as part of a document storage and retrieval device but can be advantageously employed for achieving speed matching within document transportation systems in general.

What is claimed is:

1. A document transport apparatus having a document transport path, the document transport apparatus comprising:

a first stage of the document transport path including (i) at least one pair of cooperating rollers for engaging documents therebetween, and (ii) at least one pair of belts arranged such that documents can be moved between and relative thereto while engaged by the cooperating rollers; and a second stage of the document transport path including pinching means for pinching the belts together so that documents are sandwiched for retention between the pinched belts, the speed of travel of documents in the first stage being determined by the speed of the cooperating rollers and the speed of travel of documents in the second stage being determined by the speed of the pinched belts.

2. A document transport apparatus according to claim 1, wherein the belts receive at least a peripheral portion of documents therebetween.

3. A document transport apparatus according to claim 1, wherein the belts act as a guide for transport of documents through the first stage of the document transport path.

4. A document transport apparatus according to claim 1, further comprising sensing means for detecting alignment of a document.

5. Apparatus according to claim 1, wherein the documents move when the rollers are rotating, irrespective of whether the belts are moving.

6. A document transport apparatus according to claim 1, further comprising (i) drive means for cooperating with the first and second stages of the transport path to transport a document, and (ii) sensing means located between the first and second stages of the transport path and for detecting the presence of a document, the operation of the drive means being altered in response to an output from the sensing means to further transport a document.

7. A document transport apparatus according to claim 6, wherein the drive means is altered between a stationery mode and a moving mode.

8. A document transport apparatus having a document transport path, the document transport apparatus comprising:

a storage drum;

a first stage of the document transport path including (i) at least one pair of cooperating rollers for engaging documents therebetween, and (ii) at least one pair of belts arranged such that documents can be moved between and relative thereto by the cooperating rollers;

a second stage of the document transport path including pinching means for pinching the belts together so that documents are sandwiched for retention between the pinched belts, and the speed of travel of documents in the first stage being determined by the speed of the cooperating rollers and the speed of travel of documents in the second stage being determined by the speed of the pinched belts; and a document storage device in which documents are stored between the pinched belts wound around the storage drum.

9. A document transport apparatus according to claim 8, further comprising sensing means for detecting the presence of a document.

10. A document transport apparatus according to claim 9, further comprising storage drum drive means for driving the storage drum, the operation of the storage drum being altered in response to an output from the sensing means.

11. A document transport apparatus according to claim 9, wherein operation of the at least one pair of cooperating rollers is altered in response to a signal from the sensing means.

12. A document transport apparatus according to claim 9, wherein operation of either the drive of the drum or the at least one pair of cooperating rollers is altered dependent upon whether a document is being stored or retrieved.

13. A document transport apparatus, comprising:

a) an input station, for receiving documents;

b) movable parallel tapes and rotatable rollers, between which the documents are simultaneously held;

c) a first stages in which the documents held between the tapes move at a speed which is independent of tape speed; and d) a second stage, in which speed of documents held between the tapes matches tape speed.

14. Apparatus according to claim 13, in which the first stage comprises roller-pairs which pinch the documents therebetween.

15. Apparatus according to claim 14, in which rotation of the roller-pairs causes movement of the documents.

16. Apparatus according to claim 13, in which the second stage comprises a drum upon which the tapes become wound.

17. Apparatus according to claim 16, in which the documents located between the tapes become trapped between the tapes wound upon the drum.

18. A document transport apparatus, comprising:

a) means for delivering a document to a location wherein the document is simultaneously sandwiched between rollers and belts;

b) means for initially controlling motion of said document by rotation of said rollers, wherein the document moves whether or not the belts move; and c) means for subsequently ejecting the document from said rollers, and controlling motion of the document by said belts.

19. Method for transporting a document, comprising the following steps:

a) delivering a document to a location wherein the document is simultaneously sandwiched between rollers and belts;

b) initially controlling motion of said document by rotation of said rollers, wherein the document moves whether or not the belts move; and c) subsequently ejecting the document from said rollers, and controlling motion of the document by said belts.

20. A document transport apparatus, comprising:

a) a first station, which includes a first pair of rollers (38A, 3$B), which i) squeeze the document therebetween and ii) transport the document by rotating oppositely;

b) a second station which accepts the document from the first station, and which includes i) a second pair of rollers (34A, 34B) which A) squeeze the document therebetween and B) transport the document by rotating oppositely; and ii) a pair of belts (28A, 28B) between which the document is simultaneously sandwiched and moved by rotation of the second pair of rollers; and c) a third station which accepts the document from the second station, wherein the document moves at the same speed as the belts.

21. A method of transporting a document, comprising the following steps:

a) delivering a document to a location wherein the document is simultaneously sandwiched between rollers and belts, said belts being stationary;

b) moving said document along and between the stationary belts by rotation of said rollers; and c) sensing arrival of the document at a final roller (36) and, in response, initiating motion of said belts, to thereby continue motion of the document, independent of said rollers.

22. Method of moving a document, comprising the following steps:

a) moving the document by i) squeezing it between a first pair (38A, 38B) of rollers, and ii) rotating the first pair of rollers oppositely; then b) sandwiching the document between a pair (28A, 28B) of belts, and moving the document with respect to the belts by i) squeezing the document between a second pair (34A, 34B) of rollers, ii) rotating the second pair of rollers oppositely;

c) moving the document out-of-contact with rollers, while maintaining it between said belts, and continuing to move it by moving the belts.

* * * * *

UNITED STATES PATENT AND TRADEMARK OFFICE

CERTIFICATE OF CORRECTION

PATENT NO. : 6,068,255

DATED : May 30, 2000

INVENTOR(S) : Kenneth A. Nicoll

It is certified that error appears in the above-indentified patent and that said Letters Patent is hereby corrected as shown below:

Column 7, Line 17, delete "stages" and insert --stage--.

Column 8, Line 5, delete "3$B" and insert --38B--.

Signed and Sealed this

Third Day of April, 2001

*Attest:*

Nicholas P. Godici

NICHOLAS P. GODICI

*Attesting Officer*

*Acting Director of the United States Patent and Trademark Office*